United States Patent [19]

Paul, Jr. et al.

[11] 4,163,003

[45] Jul. 31, 1979

[54] UNSATURATED EPOXIDES AS COUPLING AGENTS FOR CARBON FIBERS AND UNSATURATED MATRIX RESINS

[75] Inventors: James T. Paul, Jr.; Winfred E. Weldy, both of Wilmington, Del.

[73] Assignee: Hercules Incorporated, Wilmington, Del.

[21] Appl. No.: 580,501

[22] Filed: May 23, 1975

[51] Int. Cl.[2] ..... C08K 7/02; C08K 9/04

[52] U.S. Cl. ..... 260/40 R; 106/307; 260/42.14; 428/367

[58] Field of Search ..... 260/42.28, 40 R, 91.1 M, 260/42.14, 836, 867; 106/307

[56] References Cited

U.S. PATENT DOCUMENTS

| | | | |
|---|---|---|---|
| 3,227,665 | 1/1966 | Fourcode et al. | 260/40 R |
| 3,431,245 | 3/1969 | Scherf et al. | 260/42.28 |
| 3,696,169 | 10/1972 | Schrage et al. | 260/836 |
| 3,701,751 | 10/1972 | Schramm et al. | 260/42.28 |
| 3,728,321 | 4/1973 | Vandenburg | 260/42.28 |
| 3,756,982 | 9/1973 | Korshak | 260/91.1 M X |

*Primary Examiner*—Sandra M. Person
*Attorney, Agent, or Firm*—Michael B. Keehan

[57] ABSTRACT

The adhesion between carbon fibers and unsaturated matrix resins used in the preparation of composite structures is improved by the use of an unsaturated epoxide bifunctional coupling agent. The coupling agent can be applied to the carbon fibers or incorporated into the matrix resin system.

37 Claims, No Drawings

UNSATURATED EPOXIDES AS COUPLING AGENTS FOR CARBON FIBERS AND UNSATURATED MATRIX RESINS

This invention relates to improving adhesion between carbon fibers and unsaturated matrix resins. More particularly it relates to the use of an unsaturated epoxide compound as a bifunctional coupling agent to improve adhesion between carbon fibers and unsaturated matrix resins.

The term "carbon fibers" is used in this application in its generic sense and includes all fibers which consist essentially of carbon ranging from graphite fibers to amorphous carbon fibers. Graphite fibers are defined herein as fibers which consist essentially of carbon and have a predominate x-ray diffraction pattern characteristic of graphite. Amorphous carbon fibers on the other hand are defined as fibers which consist essentially of carbon and which have an essentially amorphous x-ray diffraction pattern. Carbon fibers can be prepared by known processes from polymeric fibrous material, such as polyacrylonitrile, polyvinyl alcohol, pitch, natural and regenerated cellulose, which processes include the steps of carbonizing or graphitizing the fiber.

A major use of carbon fibers is in the preparation of composites using a variety of different matrix resins. However, it has been observed that adhesion between carbon fibers and unsaturated matrix resins is generally lower than that desired.

Now, in accordance with this invention, it has been discovered that composites having improved adhesion between carbon fibers and unsaturated matrix resins can be obtained by use of certain unsaturated epoxide bifunctional coupling agents.

Accordingly, this invention comprises a composite structure composed of (a) carbon fibers, (b) an unsaturated matrix resin and (c) an unsaturated epoxide bifunctional coupling agent.

Another aspect of this invention comprises a process of improving the adhesion of carbon fibers and an unsaturated matrix resin by incorporating into said matrix resin an unsaturated epoxide bifunctional coupling agent.

Another aspect of this invention comprises a process of improving the adhesion between carbon fibers and an unsaturated matrix resin by modifying the surface of said carbon fibers by treatment thereof with an unsaturated epoxide bifunctional coupling agent.

Another aspect of this invention comprises carbon fibers having the surface thereof modified with an unsaturated epoxide.

The coupling agents used in accordance with this invention are unsaturated epoxides having the general structural formula:

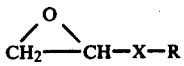

wherein X is a radical selected from the group consisting of $$\text{-}(CH_2)_n\text{-}O\text{-},$$

$$\text{-}(CH_2)_n\text{-}O\text{-}\underset{\underset{O}{\|}}{C}\text{-} \quad \text{where } n = 1\text{-}10;$$

and divalent alkyl, aryl, aralkyl and alkaryl radicals containing up to 20 carbon atoms, and R is an ethylenically unsaturated radical. Where the coupling agent is to be used with carbon fiber and ethylenically unsaturated matrix resin, R is selected from the group consisting of (a) ethylenically unsaturated $C_1$–$C_4$ aliphatic radicals, (b) aryl radicals containing an ethylenically unsaturated $C_1$–$C_4$ aliphatic substituent, (c) the alpha - terpinyl radical, (d) the gamma - terpinyl radical and (e) the abietyl radical.

When the coupling agent is to be used with carbon fiber and poly(arylacetylene)-based matrix system, R is any ethylenically unsaturated radical.

Illustrative examples of unsaturated epoxides suitable for use with any unsaturated matrix resin are vinyl glycidyl ether, allyl glycidyl ether, ortho-allyl phenyl glycidyl ether, 5,6-epoxy-n-hexyl allyl ether, 2',3'-epoxypropyl 3-butenyl ether, 9,10-epoxy-n-decyl vinyl ether, glycidyl alpha-terpinyl ether, glycidyl gamma-terpinyl ether, 1-allyl-4-(epoxyethyl)-benzene, 1-vinyl-4-(epoxyethyl)benzene, 1,2-epoxy-3-butene, 1,2-epoxy-5-hexane, 1,2-epoxy-9-decene, 1,2-epoxy-17-octadecene, glycidyl acrylate, glycidyl methacrylate, glycidyl crotonate, 5,6-epoxy-n-hexyl methacrylate, and 9,10-epoxy-n-decyl crotonate, glycidyl abietate.

Illustrative examples of unsaturated epoxides which in addition to the above are suitable for use as a coupling agent between carbon fibers and poly(arylacetylene) matrix systems are vinyl cyclohexyl glycidyl ether, glycidyl-4-hexenoate, glycidyl 4-heptenoate, glycidyl 5-methyl-4-heptenoate, glycidyl sorbate, glycidyl linoleate, glycidyl oleate, glycidyl 3-butenoate, glycidyl 3-pentenoate, glycidyl 4-methyl-3-pentenoate, the glycidyl ester of 2-cyclohexene carboxylic acid, and the glycidyl ester of 4-methyl-3-cyclohexene carboxylic acid.

The following examples served to illustrate the various aspects of this invention. In these examples parts and percentages are by weight unless otherwise specified.

EXAMPLE 1

Carbon fiber which has been electrolytically surface treated is passed through a 2% by volume solution of allyl glycidyl ether (AGE) in ethylene dichloride. This coats the fiber with AGE solution. The coated fiber is then heated to 200° C. for 2 minutes to evaporate the ethylene dichloride solvent. The amount of allyl glycidyl ether deposited on the fiber is 0.8% by weight, based on the weight of fiber. The fiber is then heated at 125° C. for 1 hour to react the allyl glycidyl ether with the carbon fiber surface.

EXAMPLE 2

The procedure of Example 1 was repeated using glycidyl acrylate in place of allyl glycidyl ether to modify the surface of carbon fiber.

EXAMPLES 3–10

Carbon fibers, modified in accordance with Examples 1 and 2, unmodified, and optionally sized as indicated in Table I are used to prepare composites. In these examples the matrix resin employed is a styrene modified unsaturated polyester prepared from isophthalic acid, maleic anhydride and propylene glycol in a ratio of 1:1:2 and modified with 42% by weight styrene. The curing agent or hardener employed in this resin system is 1% by weight, based on the weight of the resin, of t-butyl perbenzoate.

In examples 5 and 6 the carbon fiber is coated with 1.3% by weight, based on the weight of the fiber, of the styrene-modified unsaturated polyester resin as a protective size before formation of the composite.

In examples 8 and 9 allyl glycidyl ether is dissolved in the matrix resin system.

The composite specimens are made in the form of an NOL ring containing about 60% by volume of treated graphite fiber. In preparation of the composite, the graphite fiber is passed through the unsaturated polyester matrix resin system, through a tensioning device, and onto a rotating mold. The whole system is enclosed in a vacuum chamber to provide a low void composite specimen. The mold is removed from the NOL device and placed in a curing oven for one hour to harden the resin. A discussion of NOL ring specimens and their manufacture may be found in *Plastics Technology,* November 1958, pp. 1017–1024, and Proceedings of 21st Annual Technical Conference SPI Reinforced Plastics Division, Section 8-D, February 1966.

Composite samples prepared as described are tested for short beam shear strength in accordance with ASTM-2344. The results of short beam shear strength tests are shown in Table I.

EXAMPLES 11–14

Carbon fibers, unmodified or modified with allyl glycidyl ether in accordance with Example 1 are used to prepare composites using poly(arylacetylene) matrix resin system. The resin system contains a prepolymer and a fluidizer and is prepared as follows:

A polymerization vessel is charged with a mixture of 630 parts of meta-diethynylbenzene and 70 parts of para-diethynylbenzene dissolved in 3077 parts of anhydrous benzene. The solution is sparged with nitrogen and heated to reflux temperature. Then a catalyst mixture is added to the refluxing solution in four approximately equal increments prepared by mixing 4.4 parts of nickel acetylacetonate and 8.8 parts of triphenylphosphine in 50 parts of anhydrous benzene. After addition of the initial increment, the others are separately added one, two and three hours later. The solution is held at reflux temperature for a total of six and one-quarter hours, at which time the monomer conversion is 85.5%. The prepolymer then is precipitated by adding the solution to seven times its volume of petroleum ether. The yellow powder, which is separated by filtration, amounts to 406 parts. The prepolymer contains 11.8% acetylene groups.

A molding composition is prepared by dissolving in acetone the prepolymer and, as a fluidizer, a high boiling aromatic coal tar. The amount of coal tar used is 20%, by weight, based on the weight of the prepolymer. The acetone solvent is then removed in a rotary evacuator. The compositions are dried under vacuum for 16 hours at room temperature, followed by one hour at 60° C. The resulting molding composition is used with unmodified and allyl glycidyl modified carbon fibers to prepare composite NOL rings as described in Examples 3–10. The resulting composite NOL rings are tested for short beam shear strength. The results are shown in Table I.

The results in Table I show the improved adhesion, as measured by short beam shear strength, between carbon fibers and unsaturated matrix resins when allyl glycidyl ether or glycidyl acrylate is used as a coupling agent.

TABLE I

| Example | Carbon Fiber | Matrix Resin System | Composite Short Beam Shear Strength (psi) |
|---|---|---|---|
| 3 | Unmodified | Unsaturated Polyester | 7,700 |
| 4 | AGE modified (Ex. 1) | " | 11,870 |
| 5 | Sized with unsaturated polyester | " | 9,100 |
| 6 | Sized with unsaturated polyester + AGE | " | 11,200 |
| 7 | AGE Modified (Ex. 1) then sized with unsaturated polyester | " | 10,600 |
| 8 | Unmodified | Unsaturated Polyester containing 1% AGE | 10,300 |
| 9 | Unmodified | Unsaturated Polyester containing 5% AGE | 10,600 |
| 10 | Glycidyl Acrylate Modified (Ex. 2) | Unsaturated Polyester | 10,715 |
| 11 | Unmodified | Poly(arylacetylene) + fluidizer | 6,070 |
| 12 | AGE modified (Ex. 1) | " | 9,400 |
| 13 | Unmodified | " | 6,620 |
| 14 | AGE modified (Ex. 1) | " | 10,570 |

Carbon fibers employed in accordance with this invention must have a surface adhesionable or reactive with epoxide groups. To improve the adhesion between the carbon fiber surface and epoxide groups the carbon fiber surface can be pretreated, for example, by electrolytic treatment or by oxidation.

One method of employing coupling agents in accordance with this invention is to apply the coupling agent onto the fiber prior to forming the composite. The coupling agent is generally applied to the fiber in the form of a solution in a suitable solvent followed by removal of the solvent by air drying or by heating to effect evaporation. Examples of suitable solvents are benzene, polar solvents, such as halogenated hydrocarbons, for example, methylene chloride and ethylene dichloride, diacetone alcohol, ketones and esters. However, if the coupling agent is liquid, no solvent is necessary and the coupling agent can be applied directly onto the fiber.

The concentration of the coupling agent in the solvent, if one is used, is usually in the range of about 0.5 to about 5.0%, preferably about 1.0 to about 3.0% by weight, based on the total weight of the solution. The solution can be applied to the fiber by known methods, for example, by drawing the fiber through a bath containing the solution or by spraying the solution onto the fiber.

The amount of coupling agent applied to the fiber surface is from about 0.05 to about 10.0% by weight, based on the weight of the fiber, and is preferably from about 0.5 to about 3.0%.

To protect the surface modified carbon fiber of this invention from abrasion damage during subsequent handling, a size can be applied to the carbon fiber. The size can be applied from the same solution as the coupling agent or it can be applied after the carbon fiber has been modified with the coupling agent. The size selected for application to the carbon fiber will be one compatible with the unsaturated matrix resin to be used in preparing the final composite.

An alternate method of employing the coupling agent in accordance with this invention is to incorporate the unsaturated epoxide into the unsaturated matrix resin system to be used in preparing the composite. The coupling agent is used in an amount from about 1 to about 5% by weight, based on the weight of the matrix resin system.

Composites of carbon fibers and unsaturated matrix resins can be prepared by any of the known methods. For example, carbon fibers can be used to prepare filament wound composites. In another common method, the composite is prepared by incorporating chopped carbon fibers into the matrix resin and then forming the composite, for example, by press molding.

Any type of unsaturated polymer can be used as the matrix resin to prepare composites in accordance with this invention. Illustrative examples of these polymers are polybutadiene-1,2; polybutadiene-1,4; styrene—butadiene copolymers; butyl rubber (polyisobutylene—isoprene copolymers); natural rubber; polyester resins such as, for example, maleate containing polyesters and polyacrylate esters; butadiene—acrylonitrile copolymers; ethylene—propylene—dicyclopentadiene terpolymers; polychloroprene; polyisoprene; alkyd resins, such as, for example, tall oil alkyd resins; and polyether copolymers and terpolymers containing at least one unsaturated epoxide constituent such as, for example, propylene oxide—allyl glycidyl ether copolymers and ethylene oxide—epichlorohydrin—allyl glycidyl ether terpolymers. Poly(arylacetylene)-fluidizer thermosetting molding compositions are also suitable matrix resin systems.

Illustrative examples of unsaturated polyesters are polyesters prepared from polyhydric alcohols and unsaturated polycarboxylic acids or their anhydrides, optionally along with saturated polycarboxylic acids by methods well known in the art. These polyesters generally have a molecular weight of 500 to 3000 and an acid number and a hydroxyl number in each case of 20 to 50.

Examples of polyhydric alcohols which can be employed in preparation of unsaturated polyesters are ethylene glycol, propane-1,2-diol, propane-1,3-diol, butane-1,4-diol, butene-1,4-diol, dimethylpropane-1,3-diol, diethyleneglycol, dipropyleneglycol, dimethylolcyclohexane and bis-(hydroxyethyl)- or bis-(hydroxypropyl)-diphenylolmethane or -propane. Examples of unsaturated carboxylic acids are maleic acid, furmaric acid, itaconic acid and the like. Examples of saturated (i.e., free from aliphatic multiple bonds) polycarboxylic acids are phthalic acid, isophthalic acid, terephthalic acid, succinic acid, adipic acid, sebacic acid, azelaic acid, surberic acid, and cyclohexanedicarboxylic acid and their existing anhydrides. The saturated dicarboxylic acids are generally used in a proportion of 0 to 90; preferably 0 to 70 mol percent.

The unsaturated polyesters are usually employed along with copolymerizable monomers when used as a matrix resin for preparing composites. The ratio of monomer to polyester is usually in the range of 30:70 to 90:10. Examples of suitable monomers include styrene, vinyltoluene, alkylstyrenes, such as α-methyl- or tertbutylstyrene, diallyl phthalate, divinylbenzene, and esters of methacrylic or acrylic acid.

Examples of poly(arylacetylene) matrix resin systems are the thermosetting molding compositions described in U.S. Pat. No. 3,882,073, May 6, 1975, to L. C. Cessna, which is hereby incorporated by reference.

What we claim and desire to be protected by Letters Patent is:

1. A composite structure which is a cured admixture comprising (a) carbon fibers, (b) an unsaturated matrix resin and (c) an unsaturated epoxide bifunctional coupling agent having the general structural formula:

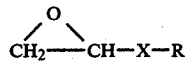

wherein X is a radical selected from the group consisting of

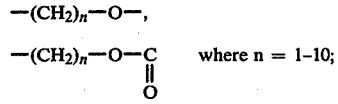

and divalent alkyl, aryl, aralkyl and alkaryl radicals containing up to 20 carbon atoms, and R is an unsaturated radical selected from the group consisting of (a) ethylenically unsaturated $C_1$–$C_4$ aliphatic radicals,
(b) an aryl radical containing an ethylenically unsaturated $C_1$–$C_4$ aliphatic substituent
(c) the alpha - terpinyl radical,
(d) the gamma - terpinyl radical and
(e) the abietyl radical.

2. The composite structure of claim 1 wherein said bifunctional coupling agent is an unsaturated glycidyl ether.

3. The composite structure of claim 2 wherein said bifunctional coupling agent is allyl glycidyl ether.

4. The composite structure of claim 1 wherein said bifunctional coupling agent is an unsaturated glycidyl ester.

5. The composite structure of claim 4 wherein said bifunctional coupling agent is glycidyl acrylate.

6. The composite structure of claim 1 wherein said unsaturated matrix resin is an unsaturated polyester resin.

7. The composite structure of claim 6 wherein said unsaturated polyester resin is a styrene modified unsaturated polyester derived from isophthalic acid, maleic anhydride and propylene glycol.

8. A composite structure which is a cured admixture comprising (a) carbon fibers, (b) poly(arylacetylene) matrix resin system and (c) an unsaturated epoxide bifunctional coupling agent having the general structural formula:

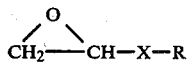

wherein X is a radical selected from the group consisting of

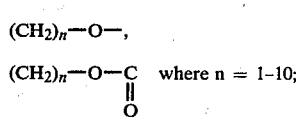

and divalent alkyl, aryl, aralkyl and alkaryl radicals containing up to 20 carbon atoms, and R is an ethylenically unsaturated radical.

9. The composite structure of claim 8 wherein said poly(arylacetylene) matrix resin system comprises (1) a prepolymer of at least one polyacetylenically substituted aromatic compound, said prepolymer having a number average molecular weight from about 900 to about 12,000, a ratio of aromatic protons to olefinic protons greater than about 2.4 and containing from about 5 to about 20% acetylenic groups by weight of the prepolymer, with (2) from about 2 to about 200%, by weight of the prepolymer, of at least one aromatic organic compound containing at least two six-membered aromatic rings, said rings being condensed with each other or coupled with each other directly or through a methylene, dimethylmethylene, ethylene or vinylene group, said compound or mixtures thereof containing no crystalline organic phase at 220° C., having a viscosity of less than 20 centipoises at 220° C. and containing no more than 5% of material volatile at 240° C.

10. The composite structure of claim 9 wherein the prepolymer comprises a polymer of a diethynylbenzene.

11. The composite structure of claim 10 wherein the polymer of a diethynylbenzene is a copolymer of a diethynylbenzene and diphenylbutadiyne.

12. The composite structure of claim 10 wherein the polymer of a diethynylbenzene is a copolymer of a diethynylbenzene and phenylacetylene.

13. The composite structure of claim 10 wherein the aromatic organic compound is anthracene.

14. The composite structure of claim 10 wherein the aromatic organic compound is the complex mixture of high boiling aromatic compounds present in high boiling fractions of coal tar pitch.

15. The composite structure of claim 8 wherein said bifunctional coupling agent is an unsaturated glycidyl ether.

16. The composite structure of claim 15 wherein said bifunctional coupling agent is allyl glycidyl ether.

17. The composite structure of claim 8 wherein said bifunctional coupling agent is an unsaturated glycidyl ester.

18. The composite structure of claim 17 wherein said bifunctional coupling agent is glycidyl acrylate.

19. A process of improving the adhesion between carbon fibers and an ethylenically unsaturated matrix resin in a carbon fiber reinforced composite structure comprising incorporating into a mixture of said matrix resin and carbon fibers, an unsaturated epoxide bifunctional coupling agent having the general structural formula:

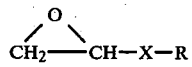

wherein X is a radical selected from the group consisting of

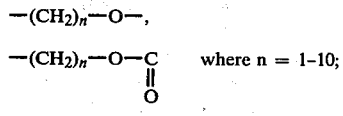

and divalent alkyl, aryl, aralkyl and alkaryl radicals containing up to 20 carbon atoms, and R is an unsaturated radical selected from the group consisting of (a) ethylenically unsaturated $C_1$–$C_4$ aliphatic radicals,
(b) an aryl radical containing an ethylenically unsaturated $C_1$–$C_4$ aliphatic substituent,
(c) the alpha - terpinyl radical,
(d) the gamma - terpinyl radical,
(e) the abietyl radical and curing the resulting mixture.

20. The process of claim 19 wherein said bifunctional coupling agent is an unsaturated glycidyl ether.

21. The process of claim 20 wherein said bifunctional coupling agent is allyl glycidyl ether.

22. The process of claim 19 wherein said bifunctional coupling agent is an unsaturated glycidyl ester.

23. The process of claim 22 wherein said bifunctional coupling agent is glycidyl acrylate.

24. The process of claim 19 wherein said unsaturated matrix resin is an unsaturated polyester resin.

25. The process of claim 24 wherein said unsaturated polyester resin is a styrene modified unsaturated polyester derived from isophthalic acid, maleic anhydride and propylene glycol.

26. A process of improving the adhesion between carbon fibers and an ethylenically unsaturated matrix resin in a carbon fiber reinforced composite structure comprising (1) modifying the surface of said carbon fibers by treatment thereof with an unsaturated epoxide bifunctional coupling agent having the general structural formula:

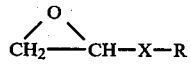

wherein X is a radical selected from the group consisting of

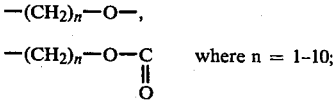

and divalent alkyl, aryl, aralkyl and alkaryl radicals containing up to 20 carbon atoms, and R is an unsaturated radical selected from the group consisting of (a) ethylenically unsaturated $C_1$–$C_4$ aliphatic radicals,
(b) an aryl radical containing an ethylenically unsaturated $C_1$–$C_4$ aliphatic substituent, (c) the alpha - terpinyl radical, (d) gamma - terpinyl radical and (e) the abietyl radical, (2) admixing the surface modified carbon fibers and an ethylenically unsaturated matrix resin, and (3) curing the resulting admixture.

27. The process of claim 26 wherein said bifunctional coupling agent is an unsaturated glycidyl ether.

28. The process of claim 27 wherein said bifunctional coupling agent is allyl glycidyl ether.

29. The process of claim 26 wherein said bifunctional coupling agent is an unsaturated glycidyl ester.

30. The process of claim 29 wherein said bifunctional coupling agent is glycidyl acrylate.

31. The process of claim 26 wherein said unsaturated matrix resin is an unsaturated polyester resin.

32. The process of claim 31 wherein said unsaturated polyester resin is a styrene modified unsaturated polyester derived from isophthalic acid, maleic anhydride and propylene glycol.

33. Carbon fibers having the surface thereof modified with an unsaturated epoxide bifunctional coupling agent having the general structure formula:

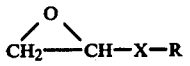

wherein X is a radical selected from the group consisting of $$-(CH_2)_n-O-,$$

$$-(CH_2)_n-O-\underset{\underset{O}{\|}}{C} \quad \text{where } n = 1\text{-}10;$$

and divalent alkyl, aryl, aralkyl and alkaryl radicals containing up to 20 carbon atoms, and R is an unsaturated radical selected from the group consisting of (a) ethylenically unsaturated $C_1$–$C_4$ aliphatic radicals, (b) an aryl radical contining an ethylenically unsaturated $C_1$–$C_4$ aliphatic substituent, (c) the alpha - terpinyl radical, (d) the gamma - terpinyl radical and (e) the abietyl radical.

34. Carbon fibers of claim 33 wherein said bifunctional coupling agent is an unsaturated glycidyl ether.

35. Carbon fibers of claim 34 wherein said bifunctional coupling agent is allyl glycidyl ether.

36. Carbon fibers of claim 33 wherein said bifunctional coupling agent is an unsaturated glycidyl ester.

37. Carbon fibers of claim 36 wherein said bifunctional coupling agent is glycidyl acrylate.

* * * * *